US005275109A

United States Patent [19]

Puckett

[11] Patent Number: 5,275,109

[45] Date of Patent: Jan. 4, 1994

[54] LONG ROD PENETRATOR

[75] Inventor: Lawrence J. Puckett, Churchville, Md.

[73] Assignee: The United States of America as represented by the Secretary of the Army, Washington, D.C.

[21] Appl. No.: 177,576

[22] Filed: Apr. 1, 1988

[51] Int. Cl.[5] ..... F42B 12/04

[52] U.S. Cl. ..... 102/501; 102/517

[58] Field of Search ..... 102/501, 503, 514–519

[56] References Cited

U.S. PATENT DOCUMENTS

| | | | |
|---|---|---|---|
| 863,698 | 8/1907 | Brown | 102/517 |
| 1,149,679 | 8/1915 | Parker . | |
| 1,908,120 | 5/1933 | Cox et al. | 102/518 |
| 1,959,737 | 5/1934 | Rigsby | 102/517 |
| 2,414,863 | 1/1947 | Foster | 102/517 |
| 3,599,576 | 8/1971 | Sliney | 102/92.4 |
| 4,016,817 | 4/1977 | Blanco | 102/1 |
| 4,187,783 | 2/1980 | Campoli et al. | 102/93 |
| 4,256,039 | 3/1981 | Gilman | 102/52 |
| 4,644,866 | 2/1987 | Sullivan | 102/501 |
| 4,708,064 | 11/1987 | Bisping et al. | 102/517 |
| 4,716,834 | 1/1988 | Wallow et al. | 102/521 |

FOREIGN PATENT DOCUMENTS

| | | | |
|---|---|---|---|
| 309293 | 1/1920 | Fed. Rep. of Germany | 102/517 |

*Primary Examiner*—Harold J. Tudor

*Attorney, Agent, or Firm*—Saul Elbaum; Guy M. Miller

[57] ABSTRACT

A kinetic energy long rod penetrator is formed from a high density metal having axially aligned elongated cavities uniformly spaced and extending longitudinally through the penetrator. These cavities allow for a long rod penetrator which is longer than previous long rod penetrators of comparable mass and material as well as a penetrator that is resistant to breakage.

5 Claims, 2 Drawing Sheets

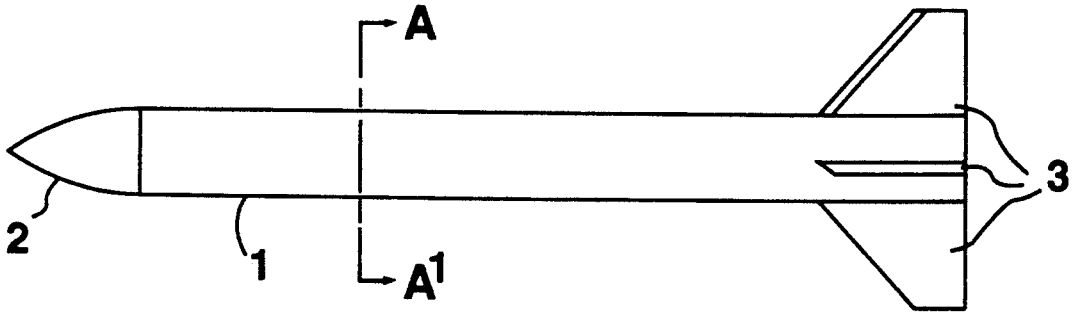
FIG. 1
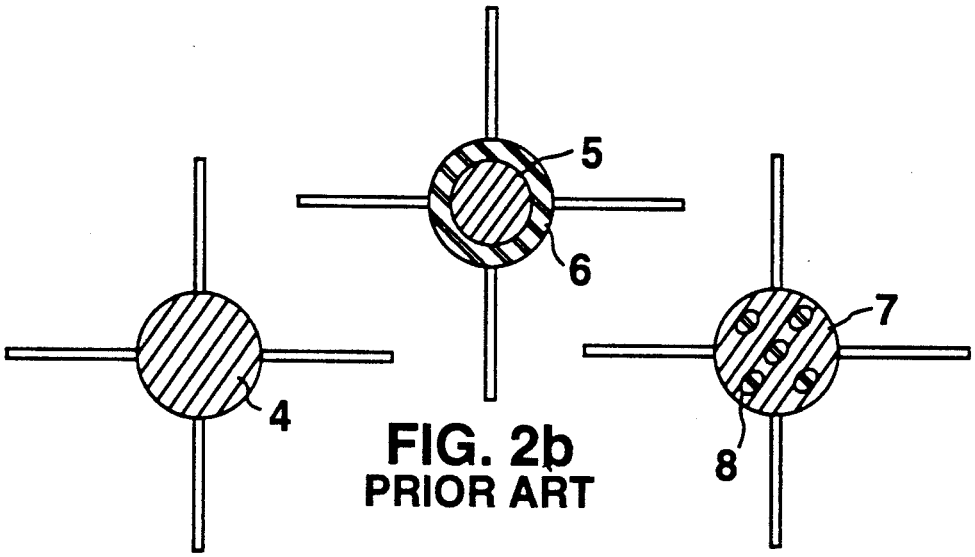
FIG. 2b PRIOR ART
FIG. 2a PRIOR ART
FIG. 2c PRIOR ART
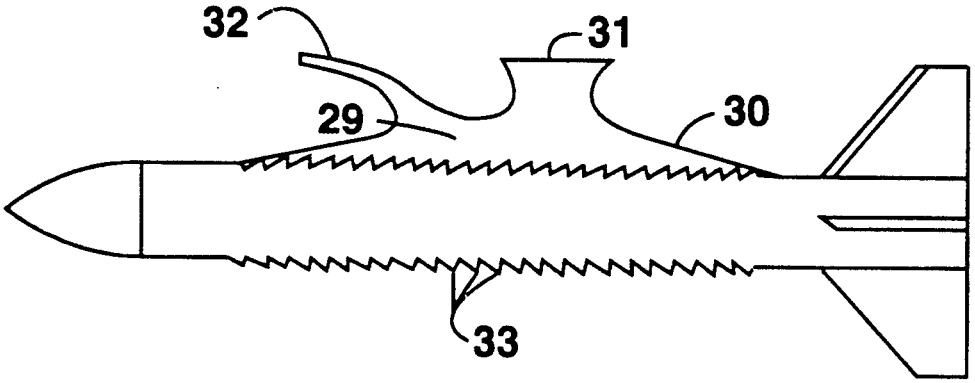
FIG. 3

LONG ROD PENETRATOR

RIGHTS OF THE GOVERNMENT

The invention described herein may be manufactured, used and licensed by or for the United States Government for Governmental purposes without payment to me of any royalty thereon.

BACKGROUND OF THE INVENTION

1. Field of the Invention:

The present invention relates generally to armor piercing projectiles and more particularly to Kinetic energy long rod penetrators that achieve greater penetration.

2. Description of the Prior Art:

The primary function of armor piercing projectiles and long rod (length/diameter≧7) penetrators is to penetrate the armor surrounding otherwise vulnerable targets, such as machines or personnel. The penetrating capability and effectiveness of the projectile depends fundamentally on its kinetic energy. The larger the mass and higher the velocity the greater the terminal effects on the target. To attain maximum penetration a variety of parameters must be considered. These parameters include, hardness, stiffness, ductility, strength, density, length and diameter. These parameters are important because they influence the interaction of the penetrator with armored targets.

For example, a trade off exists between the two parameters hardness and ductility. A long rod penetrator may be defeated upon impacting a hardened target by shock induced brittle fracture for high hardness penetrators, termed "breakup", or by excessive plastic flow for tough ductile penetrators, termed "mushrooming". The strength of the penetrator is also important during the launch process and must maintain structural integrity.

The penetration process is also influenced by the density and length of the penetrator. A penetrator that is longer and denser will achieve greater penetration, however, the larger mass imposes a burden of the gun system. It would be most desirable to provide a long rod penetrator which is long and thin (i.e. small diameter) so that the mass burden would be lessened, but this approach results in a penetrator that is structurally unsound.

Until recently, long rod penetrator materials have emphasized homogeneous, high density metals. One variant from this approach is a penetrator that comprises a high density metal core surrounded by a low density, high strength, metal sleeve. This combination tends to balance between the properties of hardness needed for penetration and ductility needed for maintaining structural integrity.

Another variant in penetrator design comprises a high density core with internally reinforcing, low density, high modulus materials such as tungsten or graphite filiments. In either case, the principles used are to increase stiffness and breakage resistance. However, no major successes have been achieved through such approaches.

SUMMARY OF THE INVENTION

It is therefore an object of this invention to provide a long rod penetrator that is resistent to breakage during the launch and penetrating processes.

Another object of this invention is to increase the penetration effectiveness of long rod kinetic energy penetrators.

An additional object of this invention is to provide a long rod penetrator which is longer and penetrates further than previous long rod penetrators of comparable mass and material.

According to this invention there is provided a kinetic energy long rod penetrator formed from a high density metal having axially aligned elongated cavities uniformly spaced and extending longitudionally through the penetrator. These cavities allow for a long rod penetrator which is longer than previous long rod penetrators of comparable mass and material as well as a penetrator that is resistant to breakage.

The above and other objects, features, and advantages of the present invention will be better understood from the following detailed description taken in conjunction with the accompanying drawings.

BRIEF DESCRIPTION OF THE DRAWINGS

FIG. 1 shows an example of a typical long rod kinetic energy penetrator of length L.

FIGS. 2A through 2C show cross sectional views of prior art long rod penetrator configurations.

FIG. 3 shows a long rod penetrator mounted in a half section of a typical state-of-the-art sabot.

DESCRIPTION OF THE PREFERRED EMBODIMENTS

Figure 4:
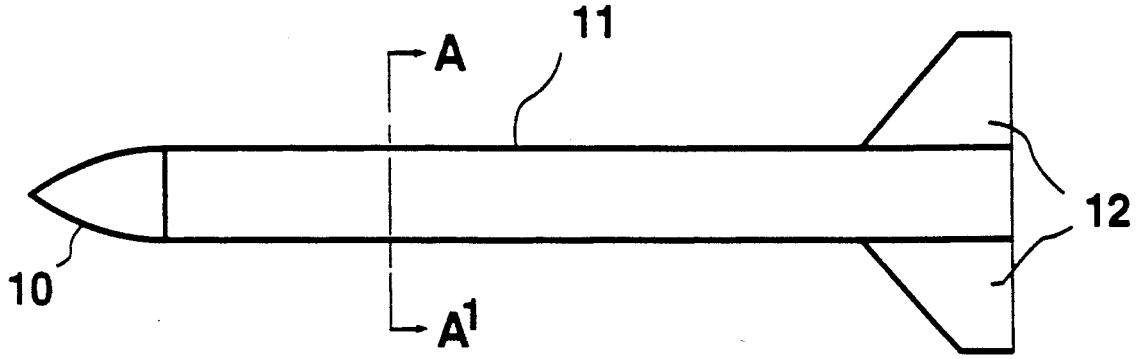
FIG. 4 shows a kinetic energy long rod penetrator in accordance with this invention.

FIG. 1 shows a prior art long rod penetrator 1, of length l, having an ogival nose section 2 and stabilizing fins 3. Cross sections of previous penetrators are shown in FIGS. 2A through 2C. FIG. 2A shows a cross section, A—A' of the long rod penetrator 1, comprising a homogenous high density metal core 4. FIG. 2B shows a smaller diameter high density metal core 5 surrounded by a low density metal sleeve 6. Another variant of known penetrators is shown in FIG. 2C which comprises a high density metal core 7 with internally reinforcing, low density, higher modulus materials such as tungsten or graphite filaments 8.

These penetrators are typically mounted in a sabot. A half section view of a typical configuration is shown in FIG. 3. The sabot 29 includes a ramp 30 which provides stiffness and sealing of gun gases, an obturator or bore rider 31, an air scoop 32 which facilitates sabot separation after launch, and subcaliber buttress grooves 33 to improve the force transfer from sabot to penetrator.

For a penetrator and target that have armor of similar hardness and in which the penetrator is in the hydrodynamic velocity regime, the depth of penetration P can be represented as $$P = L\left(\frac{\rho_P}{\rho_T}\right)^{\frac{1}{2}}.$$

For the penetrator of FIG. 1 the length, l, is represented as L and its density is represented as $\rho_P$. The density of the armor target is represented as $\rho_T$. The diameter of the penetrator does not appear in the equation. Consequently, increasing the length of the penetrator increases the penetration P in direct proportion. However, to conserve the equations of energy and momentum governing the launch conditions the mass of the penetrator must not increase. One technique that could be used involves decreasing the diameter of the penetrator so the mass saved may be added to the penetrator length. However, the diameter cannot be made arbitrarily small due to the strength requirement to prevent breakage of the penetrator. Consequently, there is a trade off between length and diameter for a constrained launcher system.

The present invention circumvents this problem by providing a long rod penetrator that uses axially aligned cavities. This technique results in the ability to create a longer penetrator than a solid penetrator of the same mass, resulting in an increase in depth of penetration.

Figure 5C:
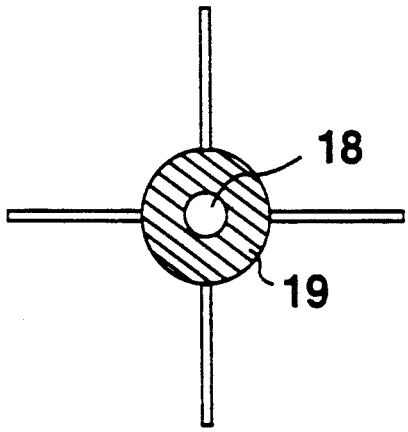
FIGS. 5A through 5C show cross sectional views of long rod penetrators in accordance with different embodiments of the present invention.
Figure 5A:
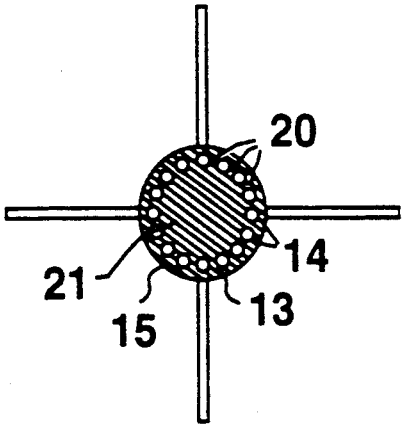
Figure 5B:
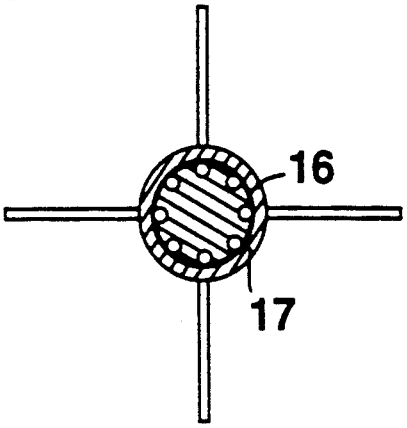

FIG. 4 shows a long rod penetrator according to the present invention comprising an ogival nose section 10, a penetrator section 11 of length $L=l+\Delta l$, and a plurality of stabilizing fins 12. FIG. 5A shows a cross section A—A' of the penetrator 11 illustrating an embodiment employing a homogeneous high density metal with axially aligned cavities 14, near, but for strength and aerodynamic reasons, preferably not intersecting the radial surface 15 of the penetrator. In order to facilitate the manufacture of the penetrator, however, the cavities may intersect the surface of the penetrator as shown in FIG. 5B. This particular embodiment has a high density metal core 16 covered with a sleeve 17 for aerodynamic reasons. Another embodiment shown in FIG. 5C, shows a single cavity 18 with a diameter approximately equal to or less than the wall thickness of the penetrator 19. Although all of these embodiments show circular cavities the actual geometry is not critical and may vary to include triangular, square, or any convenient polygon or elliptical shape.

The rod diameter, cavity size, and number of cavities should be selected to reduce mass, per unit length, while maintaining acceptable stiffness. The savings in mass may then be added, in the form of length, to the penetrator. Consequently, a penetrator with greater penetrating capability may be produced without putting an extra burden on a mass constrained gun system. A typical example is provided for illustrative purposes. Recall that the depth of penetration is given $$P = L\left(\frac{\rho_P}{\rho_T}\right)^{\frac{1}{2}}.$$

Assume that a plurality of very small uniformly spaced cavities extend through the penetrator or that one large one, as shown in FIG. 5C, is provided in the penetrator. Assume further that these cavities provide a 20% reduction in cross sectional density and mass. This means that the savings in mass may be added to the length of the penetrator making the new penetrator length $L=l+(0.2)l$. The increase in penetration is therefore projected to be $$P = [l + (.2)l]\left(\frac{\rho_P^{(1-.2)}}{\rho_T}\right)^{\frac{1}{2}} \text{ or}$$

$$P = (1.07)l\left(\frac{\rho_P}{\rho_T}\right)^{\frac{1}{2}}$$

or approximately 7%.

An even better penetrating result may be obtained by using the embodiment shown in FIG. 5A. Assume again that the cavities provide a 20% reduction in cross sectional density and mass so that the savings in mass results in a penetrator that is 20% longer. The axially aligned elongated cavities 14 are disposed within the surface of the penetrator 15 and uniformly spaced from the center axis. The cavities are further separated from one another by a thin web of material 20. This web of material is of a thickness that allows the outer shell of material 13 to sheer away from the core 21 upon target impact, resulting in the inner core of density and length $l+(0.2)l$ to penetrate the armored target on its own. The resulting increase in penetration depth becomes $$P = [l + (.2)l]\left(\frac{\rho_P}{\rho_T}\right)^{\frac{1}{2}}$$

or 20%.

An additional benefit to this design is that the material exterior to the circumferential array of axially aligned cavities, or outer shell 13, and the web of material 20 between the cavities 14, serve as a stiffening matrix for the solid inner core 21. Furthermore, the proximity of the cavities to the surface of the rod 15 and their ability to deform under impacts, act as shock absorbers protecting the inner core 21 from lateral impulses/impacts that tend to break conventional long rod penetrators.

Obviously, numerous modifications and variations of the present invention are possible in light of the above teachings. It is therefore to be understood that within the scope of the appended claims, the invention may be practiced otherwise than as specifically described herein.

What is claimed is:

1. An armor piercing projectile comprising:

a nose section;

a penetrator section having a first end in axial alignment with said nose section and joined thereto in end-to-end relationship and a second end;

said penetrator section formed of a metal suitable for penetrating armor having a plurality of axially aligned elongated cavities disposed within the surface of said penetrator section, uniformly spaced from the center axis of said penetrator section and extending longitudinally substantially from the first end to the second end of said penetrator section;

said elongated cavities disposed adjacent to one another forming a web of said metal connecting said elongated cavities effectively dividing said penetrator section into an inner core and an outer shell so that upon impact of said penetrator onto an armored target said web will tear causing the outer shell to shear away from the inner core allowing the inner core to penetrate through the armored target.

2. The armor piercing projectile of claim 1 further comprising:

a plurality of stabilizing fins attached to the second end of said penetrator section.

3. The armor piercing projectile of claim 1 wherein said penetrator section is generally cylindrical.

4. The armor piercing projectile of claim 3 wherein said penetrator section has a high length to diameter ratio.

5. The armor piercing projectile of claim 1 wherein said plurality of elongated cavities are generally equal in size.

* * * * *